United States Patent [19]

Roy et al.

[11] Patent Number: 5,030,878

[45] Date of Patent: Jul. 9, 1991

[54] ELECTRON MULTIPLIER WITH REPLACEABLE REAR SECTION

[75] Inventors: Raymond L. Roy, Monson; Peter W. Graves, Brookfield; Thomas J. Loretz, Charlton City, all of Mass.; Jonathan W. Amy, West Lafayette, Ind.; George C. Stafford, Jr., San Jose, Calif.

[73] Assignee: Detector Technology, Inc., Brookfield, Mass.

[21] Appl. No.: 320,277

[22] Filed: Mar. 6, 1989

[51] Int. Cl.[5] ..... H01J 43/04

[52] U.S. Cl. ..... 313/103 R; 313/103 CM; 313/105 CM; 313/237

[58] Field of Search .... 313/103 R, 103 CM, 105 CM, 313/237; 250/207

[56] References Cited

U.S. PATENT DOCUMENTS

| | | | |
|---|---|---|---|
| 1,920,863 | 8/1933 | Hopkin, Jr. | 179/171 |
| 2,378,164 | 6/1945 | Van Den Bosch et al. | 250/27.5 |
| 2,674,661 | 4/1954 | Law | 179/171 |
| 3,312,857 | 4/1967 | Farnsworth | 315/5 |
| 3,506,868 | 4/1970 | Ceckowski et al. | 313/103 |
| 3,634,690 | 1/1972 | Grant | 250/207 |
| 3,665,497 | 5/1972 | Deradorian et al. | 313/103 |
| 3,684,910 | 8/1972 | Stutzman et al. | 313/105 |
| 3,808,494 | 4/1974 | Hayashi et al. | 313/103 |
| 4,188,560 | 2/1980 | Swingler | 313/105 R |
| 4,652,788 | 3/1987 | Lauche et al. | 313/103 CM |

*Primary Examiner*—Palmer C. DeMeo
*Assistant Examiner*—Michael Horabik
*Attorney, Agent, or Firm*—Donald S. Holland

[57] ABSTRACT

A segmented electron multiplier is disclosed with front and rear sections. The sections are specially designed so that the length of the rear section compared to the length of the front section is no less than 4:1. This permits multiple replacements of the rear section, after the multiplier wears out, without any unsatisfactory drop in the overall electrical gain produced by the repaired device. In the preferred embodiment, the front portion is a funnel having a tubular stem, and the rear portion is a straight tube with a cylindrical helical inner channel. The length-to-length split is 5:1, which theoretically permits up to six or seven replacements of the rear section before unsatisfactory gain occurs.

10 Claims, 2 Drawing Sheets

ELECTRON MULTIPLIER WITH REPLACEABLE REAR SECTION

BACKGROUND OF THE INVENTION

This invention relates to continuous dynode electron multipliers ("CDEMs"). More particularly, it deals with replacing such multipliers, when they wear out.

As described more fully in U.S. Pat. No. 3665497 to Deradorian et al., electron multipliers have been used for years to increase ion, electron, neutral or photon signals. The increase generally ranges from the order of $10^4$ to $10^8$, depending upon the structure involved.

The Deradorian structure is shown in this application's FIG. 1. It comprises a flared inlet 2 with a stem 4—known collectively in the trade as a funnel. The stem is connected, by electrically conductive adhesive, to a series of spiraled tubes 6. These tubes 6 are made of a lead-glass compound and each tube has an inner channel (not shown) that is coated with a secondary electron emissive surface.

CDEMs have many different configurations. Some have flared inlets, while others do not. To avoid feedback, many are either spiraled or bent, and some are even straight tubes with their inner channels spiraled instead. Nonetheless, each multiplier tube is made of a lead-glass compound like Deradorian's; and each has an inner channel that is coated with a secondary-emissive layer.

Electrical contacts (not shown) are deposited onto Deradorian's inlet 2 and the outlet end 8 of tubes 6. This allows good electrical contact between an external voltage source and the CDEM. This voltage source serves a dual purpose: it charges the secondary-emissive surface, inside the channel; and it draws the electrons through the channel, accelerating them along the way.

Electrons enter Deradorian's flared inlet 2, where they are directed to the tubes 6, by the applied voltage. As they hit the secondary-emissive wall, each electron breaks off a new counterpart, and each pair continues to multiply by factors, typically greater than one, as they travel downstream.

It has been proved that CDEMs produce high gains at low voltage, with little accompanying electrical noise. In addition, they are compact, with this application's FIG. 2 sketches being larger than their real-life counterparts.

Due to these characteristics, CDEMs have achieved widespread use in scientific and medical instruments. In almost all cases, the internal structures of these instruments are quite compact, especially when available space is a limited commodity.

CDEMs work well, but like all parts they eventually wear out. Most CDEMs last about one year. After they are exhausted, electron multipliers usually can be replaced. However, due to the compact nature of the equipment involved, this is often a tedious and delicate task.

Most times, the entire multiplier has to be replaced. However, there are some multipliers that are segmented, with front and rear portions. Such devices are shown in Deradorian's aforementioned patent and U.S. Pat. No. 3312857 to Farnsworth. In both types, the front section is approximately equal in length to the rear section; and the rear section could possibly be replaced once before unsatisfactory gains occur.

Accordingly, it is a primary object of the present invention to provide a specially segmented CDEM, which allows for multiple replacement of its rear section before unsatisfactory gain degradation occurs.

It is another object to provide a segmented CDEM with a removable rear section, wherein the CDEM is extremely simple in design and easy to repair.

It is yet another object to provide a CDEM, commensurate with the above-listed objects, which is highly reliable during use.

SUMMARY OF THE INVENTION

Applicant has determined that the degradation of the CDEM's secondary-emissive surface (and the resulting life of the device) is directly related to the number of electron (ion) bombardments. During the electron multiplication process, the density of these electrons (ions) is continually increasing and reaches a maximum at the output end of the CDEM. As a result, the output of the CDEM will become unusable long before the input end.

The input end of the CDEM is, like in Deradorian, usually funneled. It is the most expensive part of the CDEM to manufacture. Accordingly, the present invention deals with a specially designed CDEM, in which the rear section can be replaced up to six or seven times before unsatisfactory gain degradation occurs. With the present invention, this is accomplished by manufacturing two separate sections (see FIG. 2).

The front section includes a flared input section attached to a short cylindrical stem section—collectively known as a funnel. The rear portion consists of only a cylindrical rear section; however, this rear cylindrical section is much longer than the cylindrical stem section attached to the funnel. Although the front stem section and the rear section differ in length, they have equivalent inner and outer diameters. These two sections are removably attached by any suitable means, such as a standard fuse clip.

In order to maximize the number of replacements of the rear section that can be made before the entire multiplier must be thrown away, Applicant has determined an appropriate ratio entitled the "overall" ratio. Typically, in the field, this overall ratio would be composed of yet two more ratios: (i) the front cylindrical stem section length-to-inner-diameter (hereinafter "front stem length-to-diameter") and (ii) the rear cylindrical length-to-inner-diameter (hereinafter "rear section length-to-diameter"). The overall ratio is then the ratio of the rear section length-to-diameter to the front stem length-to-diameter.

Because both the front and rear cylindrical sections contain both a constant inner and outer diameter (in the illustrated embodiment), the same result found by using the overall ratio, however, may be found by simply comparing the length of rear cylindrical sections to the length of the front cylindrical stem. For purposes of this application, applicant will now use this simple rear cylindrical section length to front cylindrical stem length (hereinafter "length-to-length") ratio.

In more complicated situations, like divergent channels (not shown), one may be forced to actually determine the ratio of the length-to-inner diameter of the rear cylindrical section and compare it to the length-to-inner diameter of the cylindrical front stem. But, as Applicant has shown, that computation is unnecessary when referring to the illustrated embodiment because this embodiment shows both a constant inner and outer diameter.

Applicant has discovered that the key to satisfactory multiple replacements is to have the tubular rear section be vastly "electrically longer" than the front, or usually funneled, section of the multiplier. If there is approximately a 3:1 length-to-length split between the stem of the front section and the tubular stem of the front section a one-time replacement of the rear section is marginally worthwhile. But, if the split is no less than 4:1 (that is, the length of the rear section is at least four times greater than the length of the front stem), as in the preferred embodiment, the rear section can be replaced multiple times, with satisfactory gains still being achieved after each replacement.

The above and other objects and advantages of this invention will become more readily apparent when the following description is read in conjunction with the accompanying drawings.

DETAILED DESCRIPTION OF THE PREFERRED EMBODIMENT

Figure 2:
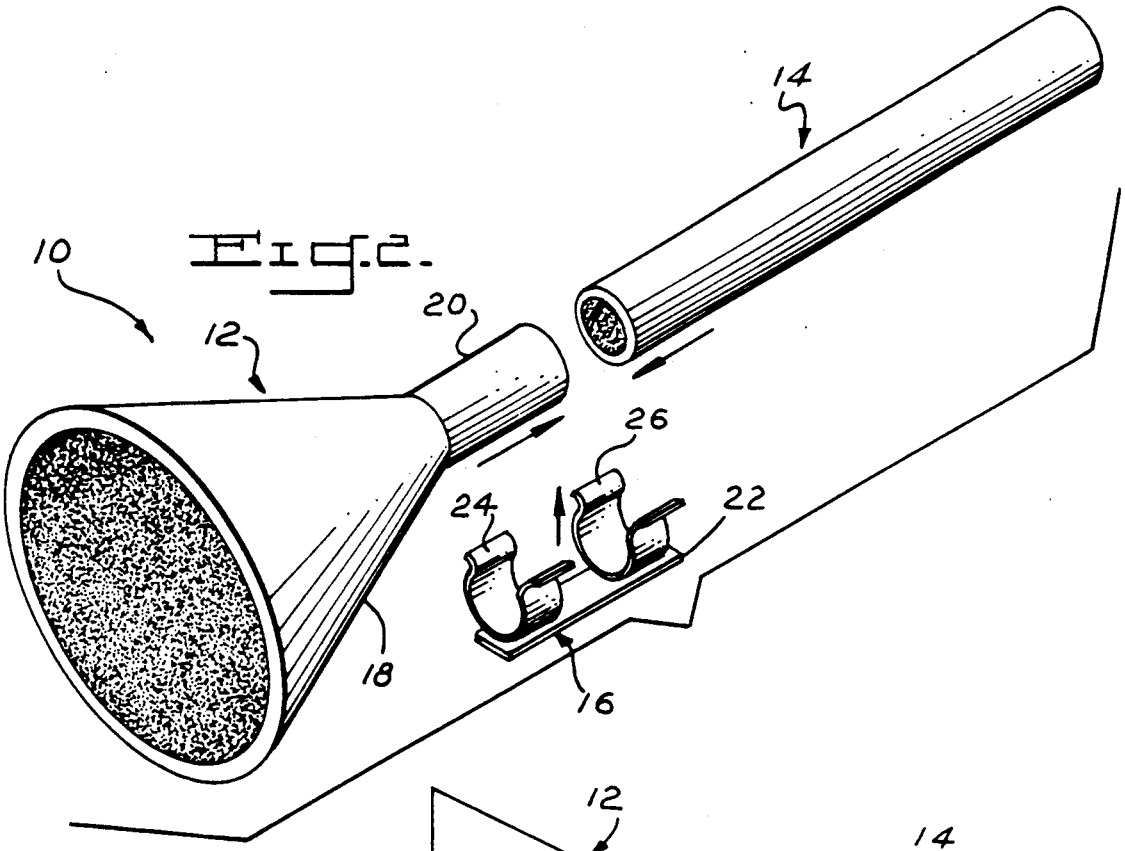
FIG. 2 is an exploded view of a segmented electron multiplier constructed in accordance with the present invention.
Figure 3:
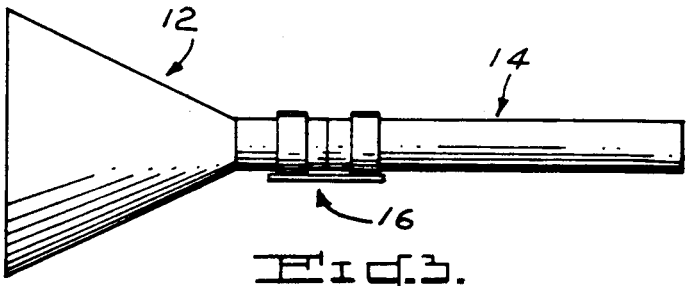
FIG. 3 is a side elevational view of the FIG. 2 parts assembled.

Referring to FIGS. 2–3, a segmented CDEM or detector is shown and generally designated by the reference numeral 10. This preferred embodiment comprises a funneled front portion 12; a tubular rear portion 14; and a metal fuse clip or other connecting means 16 for removably connecting the front and rear portions together.

Front portion 12 includes a flared inlet 18. It leads to a tubular stem 20 having a central throughbore or channel (not shown). This stem is made of any standard lead-bismuth glass compound, and its inner channel is coated with a standard secondary-emissive layer.

In the preferred embodiment, the outer diameter of the stem 20 is approximately 0.195 inches. Its inner diameter is approximately 0.035 inches.

Rear section 14 has the same or matching inner and outer diameters as the stem 20. While the stem 20 has a straight inner channel, the rear section's channel is a cylindrical helix (not shown) inside the tube 14, to prevent ion feedback. As an alternative, the rear section's channel does not need to be helical; instead, a tube itself can be bent to achieve the same result.

As best shown in FIG. 2, clip or other connecting means 16 resembles a standard metal fuse clip. It includes a flat base 22 and two aligned horseshoe-shaped clip springs 24, 26—one in the front and one in the back.

To assemble the detector, stem 20 is slipped into the front clip spring 24. Then, the detector's rear tube 14 is inserted into the back clip spring 26; and the front and rear sections 12, 14 are slid together. Adhesive can, but need not be applied.

The clip or other connecting means 16 serves three purposes: it properly aligns the inner channels of stem 20 and rear section 14; it provides a metal contact between the front and rear sections of the detector; and it allows for quick replacement of the rear section, after it becomes worn out.

In operation, when the detector becomes unsatisfactory, the rear section is removed and replaced. Due to the clip or other connecting means configuration, this is an easy procedure that minimizes equipment downtime. Also, it can be performed in tight working spaces.

Figure 1:
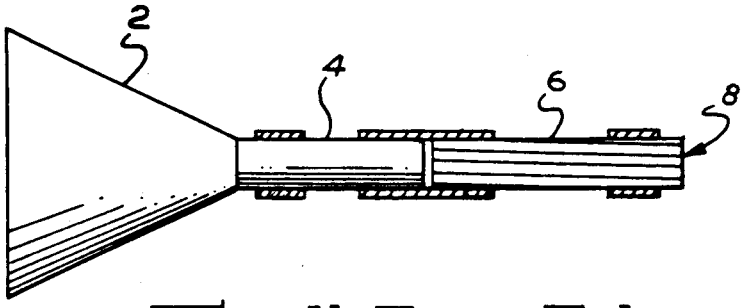
Fig.1. Prior Art
FIG. 1 is a side elevational view, partly in cross section, of the "Prior Art" multiplier described in U.S. Pat. No. 3665497 Deradorian et al.

At first glance, the segmented detector 10 (shown in FIGS. 2–3) looks just like the Deradorian detector shown in FIG. 1. However, upon closer inspection, the reader will see that the stem 20 of funnel 12 is much shorter than Deradorian's; and the present invention's rear portion 14 is much longer.

The length-to-length split in Applicant's segmented detector 10 is approximately 5:1 (that is, the length of the rear section 14 is approximately five times greater than the length of the front tubular stem section 20). This design provides a detector in which the vast majority of the gain occurs in the rear section 14.

Through testing, Applicant has determined that the 5:1 length-to-length split permits the rear section 14 to be replaced, at least four times before unsatisfactory results occur; and it is believed that, theoretically, the replacement can occur up to six or seven times—given optimum manufacturing conditions. Each time the rear section is replaced, the entire detector or multiplier 10 works about 90% as effective as the "generation" before. (This 10% dropoff is caused by the continuing decay of the stem 20.) Theoretically, after seven replacements, the multiplier would work at about 50% of its original efficiency. Anything below 50% is considered commercially unacceptable by Applicant.

Figure 4:
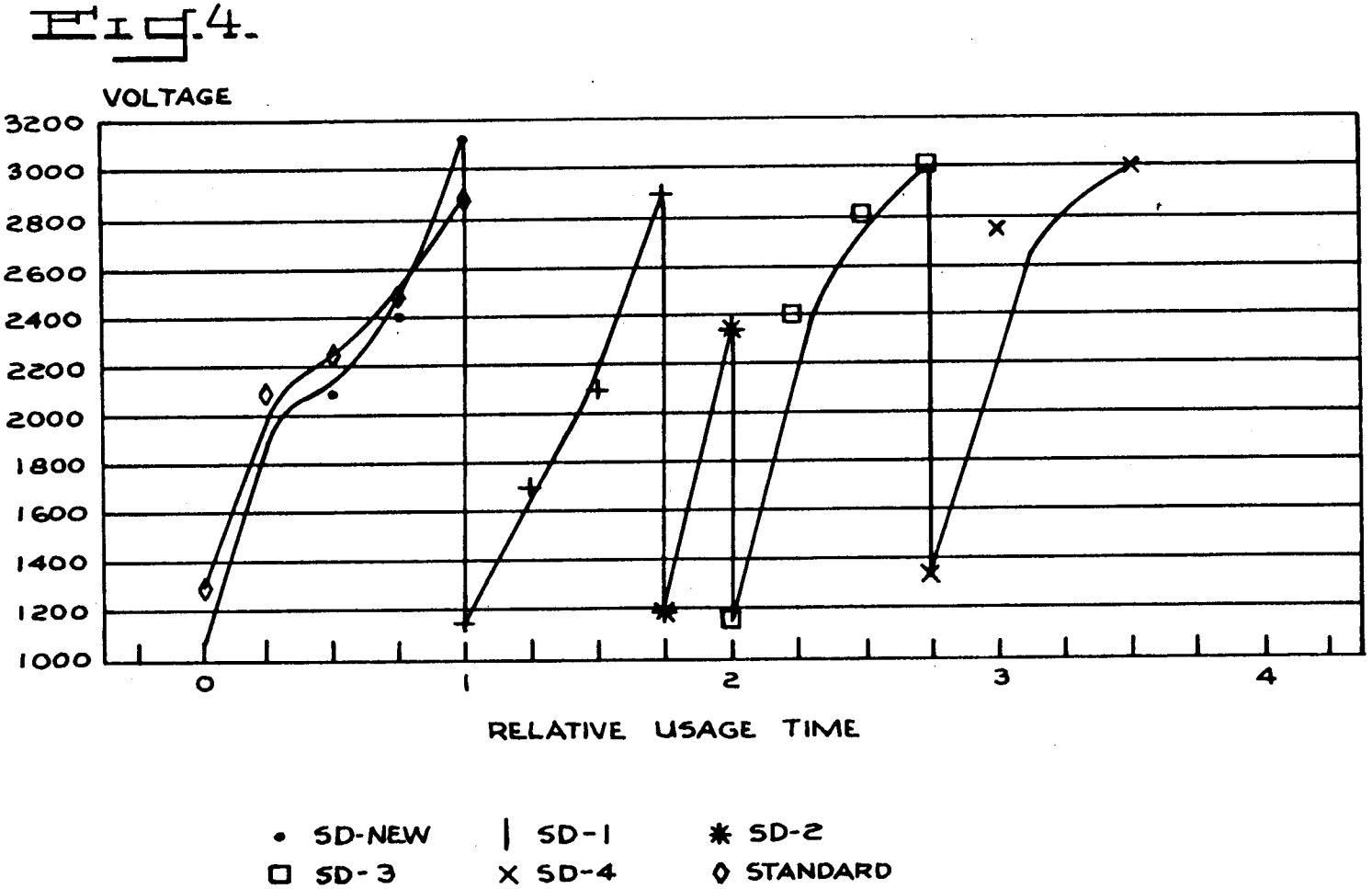
FIG. 4 is a chart showing the life gain curves of the present invention, both before and after multiple replacements of its rear section.

FIG. 4 demonstrates another standard that Applicant uses to determine when a multiplier, or multiplier replacement, becomes defective. For practical purposes, Applicant believes that a detector becomes unsatisfactory when the voltage needed to run it increases to over 3,000 volts.

As a multiplier starts to degrade, it requires higher and higher voltage to maintain the same electrical gain. And, when the voltage required exceeds 3,000 volts, a replacement is warranted. FIG. 4 shows the lifetime that will occur for the original multiplier 10 and the relative lifetimes for subsequent replacements of its rear section 14.

While a 5:1 length-to-length split is preferred, Applicant has determined that the cutoff for multiple replacements is a 4:1 ratio. Anything smaller typically gives less than a 50% gain, after more than one replacement.

It should be understood by those skilled in the art that obvious structural modifications can be made without departing from the spirit or scope of the invention. Accordingly, reference should be made primarily to the accompanying claims, rather than the foregoing specification, to determine the scope of the invention.

Having thus described the invention, what is claimed is:

1. A segmented, continuous dynode electron multiplier for producing electron gain, said multiplier comprising:

a. a funneled inlet section with a tubular stem, said stem having a channel with a secondary electron emissive layer;

b. a tubular rear section that is removably connected to the stem, said rear section having a channel with a secondary electron emissive layer; and c. wherein the ratio of the length of the tubular rear section to the length of the stem is no less than 4:1, whereby multiple replacements of the rear section can be made, after the rear section wears out, before unsatisfactory gain degradation occurs.

2. The segmented multiplier of claim 1 wherein the ratio is greater than 4:1.

3. The segmented multiplier of claim 1 wherein the ratio is substantially 5:1.

4. The segmented multiplier of claim 1 wherein the inlet and rear sections are removably connected, and the stem and rear sections are aligned with one another, by a fuse clip.

5. A segmented, continuous dynode electron multiplier for producing electron gain, said multiplier comprising:

a. a funneled inlet section with a tubular stem, said stem having a channel with a secondary electron emissive layer;

b. a tubular rear section that is removably connected to the stem, said rear section having a channel with a secondary electron emissive layer;

c. a metal fuse clip that aligns and connects the sections, said clip having a flat base and two horseshoe clip springs, whereby the stem is mounted within one of the springs and the rear section is mounted in the other; and d. wherein the ratio of the length of the tubular rear section to the length of the stem is no less than 4:1, whereby multiple replacements of the rear section can be made, after the rear section wears out, before unsatisfactory gain degradation occurs.

6. The segmented multiplier of claim 5 wherein the ratio is greater than 4:1.

7. The segmented multiplier of claim 5 wherein the ratio is greater than 5:1.

8. A segmented, continuous dynode electron multiplier for producing electron gain, said multiplier comprising:

a. a funneled inlet section with a tubular stem, said stem having a channel with a secondary emissive layer;

b. a tubular rear section that is removably connected to the stem, said rear section having a channel with a secondary emissive layer;

c. a connecting means that aligns and removably connects the sections, whereby the stem is mounted within one portion of the means and the rear section is mounted in another in an end-to-end relationship; and d. wherein the ratio of the length to the tubular rear section to the length of the stem is no less than 4:1, whereby multiple replacements of the rear section can be made, after the rear section wears out, before unsatisfactory gain degradation occurs.

9. The segmented multiplier of claim 8 wherein the ratio is greater than 4:1.

10. The segmented multiplier of claim 8 wherein the ratio is greater than 5:1.

* * * * *